US007032365B2

(12) United States Patent
Cinotti

(10) Patent No.: US 7,032,365 B2
(45) Date of Patent: Apr. 25, 2006

(54) PACKAGING MACHINE FOR WRAPPING PRODUCTS IN RELATED WRAPPING SHEETS MADE OF HEAT-SEALABLE MATERIAL

(75) Inventor: Andrea Cinotti, Bologna (IT)

(73) Assignee: KPL Packaging S.p.A., Casalecchio Di Reno (IT)

( * ) Notice: Subject to any disclaimer, the term of this patent is extended or adjusted under 35 U.S.C. 154(b) by 0 days.

(21) Appl. No.: 10/997,056

(22) Filed: Nov. 23, 2004

(65) Prior Publication Data

US 2005/0132671 A1 Jun. 23, 2005

(30) Foreign Application Priority Data

Nov. 28, 2003 (EP) ..... 03425767

(51) Int. Cl.
*B65B 9/06* (2006.01)
*B65B 35/50* (2006.01)

(52) U.S. Cl. ..... 53/540; 53/568; 53/201; 53/550; 53/371.5

(58) Field of Classification Search ..... 53/201, 53/202, 568

See application file for complete search history.

(56) References Cited

U.S. PATENT DOCUMENTS

| | | | | |
|---|---|---|---|---|
| 3,243,033 | A * | 3/1966 | Merchant et al. | 198/577 |
| 3,329,252 | A * | 7/1967 | Anderson | 53/438 |
| 3,391,520 | A * | 7/1968 | Albrecht | 53/202 |
| 3,605,380 | A * | 9/1971 | Dille | 53/202 |
| 4,430,844 | A * | 2/1984 | James | 53/450 |
| 4,679,379 | A * | 7/1987 | Cassoli | 53/438 |
| 5,056,294 | A * | 10/1991 | Focke | 53/201 |
| 5,195,300 | A | 3/1993 | Kovacs et al. | |
| 5,765,336 | A * | 6/1998 | Neagle et al. | 53/201 |
| 6,907,716 | B1 * | 6/2005 | Cinotti et al. | 53/550 |

FOREIGN PATENT DOCUMENTS

| | | |
|---|---|---|
| EP | 0 728 668 | 8/1996 |
| EP | 1 127 791 | 8/2001 |
| WO | WO 00/05138 | 2/2000 |

* cited by examiner

*Primary Examiner*—John Sipos
(74) *Attorney, Agent, or Firm*—Klarquist Sparkman, LLP

(57) ABSTRACT

The wrapping of groups of products positioned according to a determined number of mutually superposed layers is achieved by feeding in succession groups of products firstly into a tubular case made to heat-sealable material and, then, to a first wrapping device when the number of layers is equal to one and to a second wrapping device when the number of layers is at least equal to two; the two wrapping devices being able to wrap each group inside a related wrapping sheet, which is folded substantially in contact with the related group, and which is stabilized by means of sealing operations.

12 Claims, 5 Drawing Sheets c)
e)
2a
3
4
5
31
32
43
44
45
46
47
C1

PACKAGING MACHINE FOR WRAPPING PRODUCTS IN RELATED WRAPPING SHEETS MADE OF HEAT-SEALABLE MATERIAL

CROSS REFERENCE TO RELATED APPLICATIONS

This application claims priority under 35 U.S.C. § 119 from European Patent Application No. 03425767.5, filed Nov. 28, 2003. The prior application is incorporated herein by this reference.

BACKGROUND

The present invention relates to a packaging machine for wrapping groups of products in related wrapping sheets made of heat-sealable material.

In the description that follows, the groups of products taken into consideration are groups of paper rolls, whereto the present description shall make explicit reference without thereby relinquishing its general nature.

Known packaging machine for paper rolls normally comprise a first wrapping unit to form a tubular case from a continuous strip of heat-sealable material and to stabilise the tubular case by a longitudinal sealing operation; a conveyor device to feed in succession groups of rolls, each whereof is constituted by a plurality of rolls positioned side by side to each, inside the tubular case; a separator device to separate, in succession from the aforesaid tubular case, tubular wrappers, each of which is wound around a related group of rolls, and has two open tubular ends projecting from the related group of rollers; and a second wrapping unit to fold each tubular end substantially in contact with the related group of rolls and to form an external case having two end superposition areas, which are stabilised by respective sealing operations.

The known packaging machines described above have some drawbacks, mainly deriving from the fact that such machines have relatively low flexibility because they are suitable to package the groups of rolls solely in one type of external case, i.e. in an external case obtained starting from the aforesaid tubular wrapper and by folding and stabilising the aforesaid open tubular end.

SUMMARY

An object of the present invention is obtain a packaging machine for wrapping groups of products in related wrapping sheets made of heat-sealable material which is free from the aforesaid drawbacks and has a high degree of flexibility.

According one embodiment, a packaging machine for wrapping groups of products in related wrapping sheets of heat-sealable material, each group comprising products arranged according to a determined number of mutually superposed layers, the machine comprising first wrapping means to form a tubular case from a continuous strip of heat-sealable material, the tubular case having a first longitudinal superposition area defined by superposition portions of the strip; conveyor means to feed in sequence groups of products into the tubular case, each group being positioned between two free tubular portions of said tubular case; stabiliser means to stabilise said first superposition area; separator means to separate in succession tubular wrappers from said tubular case, each of which wrappers is wound about a related group, and has two open tubular ends projecting from the related group; second wrapping means to fold each said tubular end substantially in contact with the related group, form a first external wrapper having two end superposition areas, and perform a sealing operation on the second superposition areas; and being characterised in that it further comprises third wrapping means to fold each said tubular portion substantially in contact with the related groups, perform a sealing operation on the tubular portion, and separate in succession from said tubular case second external wrappers wrapped around respective groups; and feeding means for selectively feeding the groups and the related tubular wrappers to said second wrapping means to obtain said first external wrappers and the groups and the tubular case to said third wrapping means to obtain said second external wrappers; said separator means being able to be selectively operated to separate the tubular wrappers from the tubular case.

BRIEF DESCRIPTION OF THE DRAWINGS

The present invention shall now be described with reference to the accompanying drawings, which illustrate a non limiting embodiment thereof, in which.

DETAILED DESCRIPTION OF THE INVENTION

Figure 1:
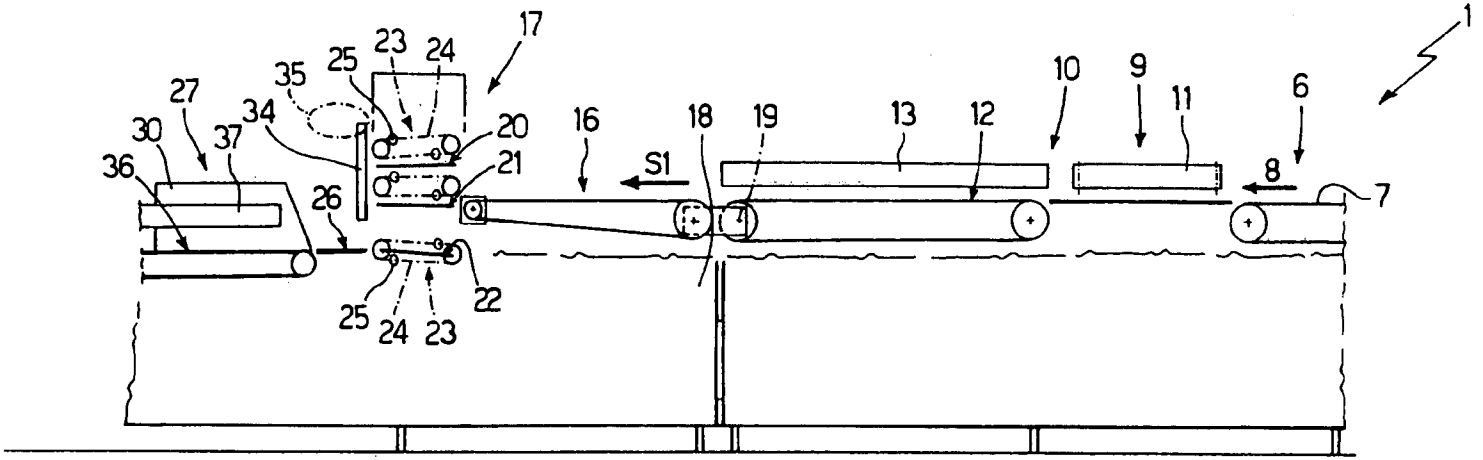
FIGS. 1 and 2 schematically show a lateral elevation view with some parts removed for the sake of clarity, a preferred embodiment of the packaging machine of the present invention.

With reference to FIGS. 1 through 6, the number 1 globally designates a packaging machine for wrapping groups 2 of products 3, i.e. paper rolls 3, in related wrapping sheets 4 of transparent heat-sealable material. Each group 2 is formed by a plurality of rolls 3 sorted according to a determined number n of superposed layers 5.

Figure 3:
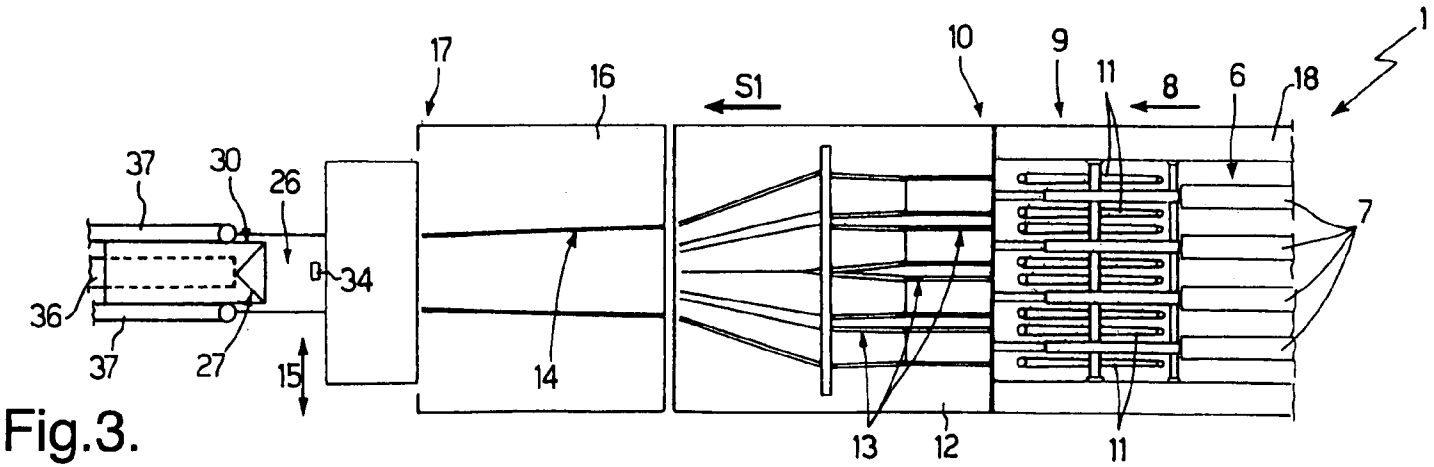
FIGS. 3 and 4 schematically show a plan view with some parts removed for the sake of clarity, the packaging machine of FIG. 1.
Figure 2:
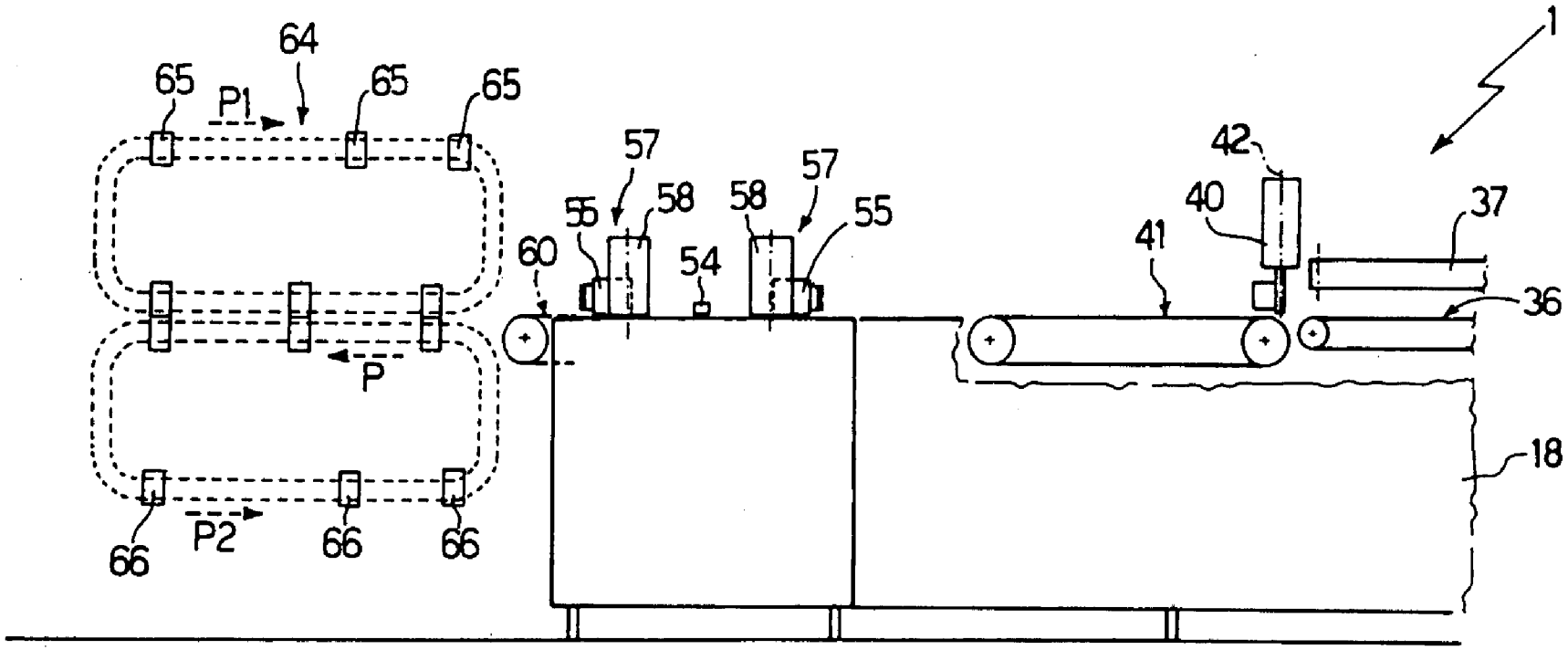

As illustrated in FIGS. 1 and 3, the machine 1 comprises an input conveyor 6 defined, in this case, by four lower mutually parallel belt conveyors 7, which continuously feed respective rows of rolls 3 in a determined direction of advance 8 and by a launch conveyor 9 connected to the conveyor 6in correspondence with a transfer station 10.

In the conveyors 7, the rolls 3 are arranged with their longitudinal axes parallel to the direction 8 and substantially in mutual contact.

The conveyor 9 comprises four pairs of lateral belt conveyors 11 able to advance the rolls 3 fed to the station 10 from the corresponding conveyors 7 in continuous fashion and with a greater speed of advance than the speed of advance imparted to the rolls 3 by the conveyors 7 in such a way as to distance each roll 3 from the successive roll 3.

The rolls 3 are then unloaded onto an upper transport branch of a ring conveyor 12, which advances the rolls 3 in ordered succession and in continuous fashion along four channels 13 of advance obtained above the transport branch of the conveyor 12.

The channels 13 converge with each other to unload in succession layers 5 of rolls 3, each of which is defined by four rolls 3, inside a channel 14 of advance, which has a width, measured parallel to a direction 15 perpendicular to the plane of the sheet of FIG. 1, substantially equal to four times the diameter of a roll 3, and is obtained above an upper transport branch of a ring conveyor 16 defining part of a layering device 17.

The conveyor 16 is hinged to a fixed frame 18 of the machine 1 to oscillate, relative to the frame 18 and under the thrust of a known actuating device, not shown herein, about a pivot axis 19 that is parallel to the direction 15 in such a way as to selectively unload the layers 5 above three transport planes 20, 21 and 22 positioned above each other.

Each plane 20, 21 and 22 is associated to an advancement device 23, which advances the related layers 5 along the plane 20, 21 and 22, and comprises two mutually parallel chain conveyors 24, and a plurality of thrust bars 25 (in this case, two thrust bars 25), which extend in the direction 15 and between the conveyors 24, are uniformly distributed along the conveyors 24, and each of them is advanced in phase with a respective bar 25 of the other devices 23.

In use, when the groups 2 to be wrapped are groups 2 defined by a single layer 5, the conveyor 16 is maintained in correspondence with the lower plane 22 to unload in succession on the plane 22 the layers 5, which are advanced in turns by the related device 23 along the plane 22 itself and above a plane 26 for feeding a wrapping unit 27.

On the contrary, when the groups 2 to be wrapped are groups 2 defined, for example, by two layers 5, the conveyor 16 is positioned alternatively in correspondence with the planes 21 and 22 to unload a layer 5 on each of the planes 21 and 22. The layers 5 of a same group 2 are then advanced along the related planes 21 and 22 in phase with each other in such a way as to be unloaded onto the plane 16 one above the other.

The unit 27 comprises a device 28 for feeding a continuous strip 29 (FIG. 4) of heat sealable material to a forming device 30 having substantially tubular shape, within which the strip 29 is folded in such a way as to form a tubular case 31 (FIGS. 5*a* and 6*a*) having a longitudinal superposition area 33 defined by two superposed portions of the strip 29. The device 28 comprises a rotating pre-notching roll 33 (FIG. 4), which is moved to an operative position, in which the roller 33 engages the strip 29 to pre-notch the strip 29, when the groups 2 are defined by a single layer 5, and to a resting position, in which the roller 33 disengages the strip 29, when the groups 2 are defined by at least two mutually superposed layers 5.

The groups 2 are fed in succession inside the case 31 by means of a thrust element 34 fastened to a chain conveyor 35 and able to engage each group 2 posteriorly in the direction 8.

The machine 1 shall now be described with reference to groups 2 constituted by a single layer 5 and hereafter defined as groups 2*a*, whilst it shall be better described hereafter with reference to groups 2 constituted by at least two mutually superposed layers 5, hereafter defined as groups 2*b*.

The groups 2*a* and the case 31 are advanced in succession inside, and at the output from, the device 30 above an upper transport branch of a belt conveyor 36, which co-operates with two lateral belt conveyors 37 to advance in continuous fashion the groups 2*a* through a sealing station 38 (FIG. 4), in correspondence with which the area 32 is stabilised by means of a sealing operation performed by a longitudinal sealing device 39, movable between an operative sealing position and a resting position.

Figure 4:
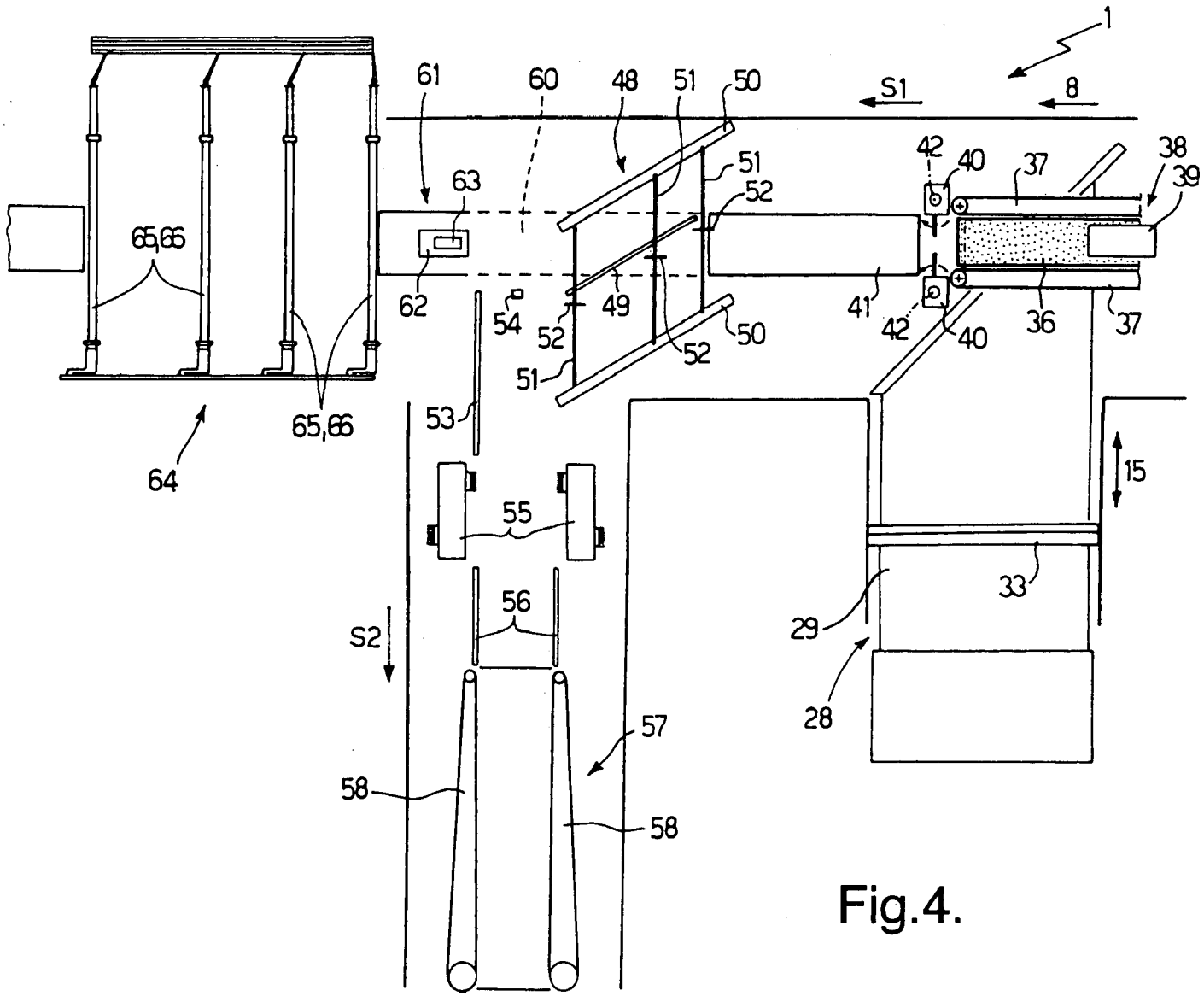

With reference to FIGS. 3 and 4, at the output of the station 38, the groups 2*a* and the case 31 are advanced by the conveyors 36 and 37 in the first place between two rotating blades 40 and, then, between the lower and upper transport branches of two belt conveyors 41 actuated in such a way as to advance the groups 2*a* with a greater speed of advance than the speed of advance imparted to the groups 2*a* by the conveyors 36 and 37.

The blades 40 are mounted to rotate in continuous fashion about respective substantially vertical longitudinal axes 42, are movable between an operative position, in which they engage the case 31, and a resting position, in which they are placed at a determined distance from the case 31, and they co-operate, when they are in their operative position, with the two conveyors 41 to separate in succession from the case 31 tubular wrappers 43 (FIG. 5*b*), each of which is wound about a related group 2*a*, and has two open tubular ends 44, each of which projects from the related group 2*a* itself, and has an upper portion 45, a lower portion 46, and two lateral portions 47.

The groups 2*a* and the related wrappers 43 are fed by the conveyors 41 to a switching device 48, which is movable between an operative position and a resting position, and comprises a fixed board 49 positioned according to a determined angle relative to the direction 8 to be engaged by a front end of the groups 2*a*, two belt conveyors 50 parallel to the board 49, and a plurality of thrust bars 51, which are mounted on the conveyors 50 in such a way as to remain always parallel to the direction 15, are uniformly distributed along the conveyors 50, and are advanced by the conveyors 50, each in phase with a respective group 2*a*.

Each bar 51 engages the upper portion 45 of a wrapper 43 positioned posteriorly in the direction 8 in such a way as to fold it substantially in contact with the related group 2*a* (FIG. 5*c*), and co-operates with a planar element 52 orthogonal to the direction 15 to move the related group 2*a* along the board 49 with the related rolls 3 always orthogonal to the direction 15. At the output of the device 48 and as a result of the impact against a fixed board 53 parallel to the direction 15, the upper portions 46 positioned anteriorly in the direction 8 are folded substantially in contact with the related groups 2*a* (FIG. 5*c*).

Figures 5A, 5B, 5C, 5D, 5E:
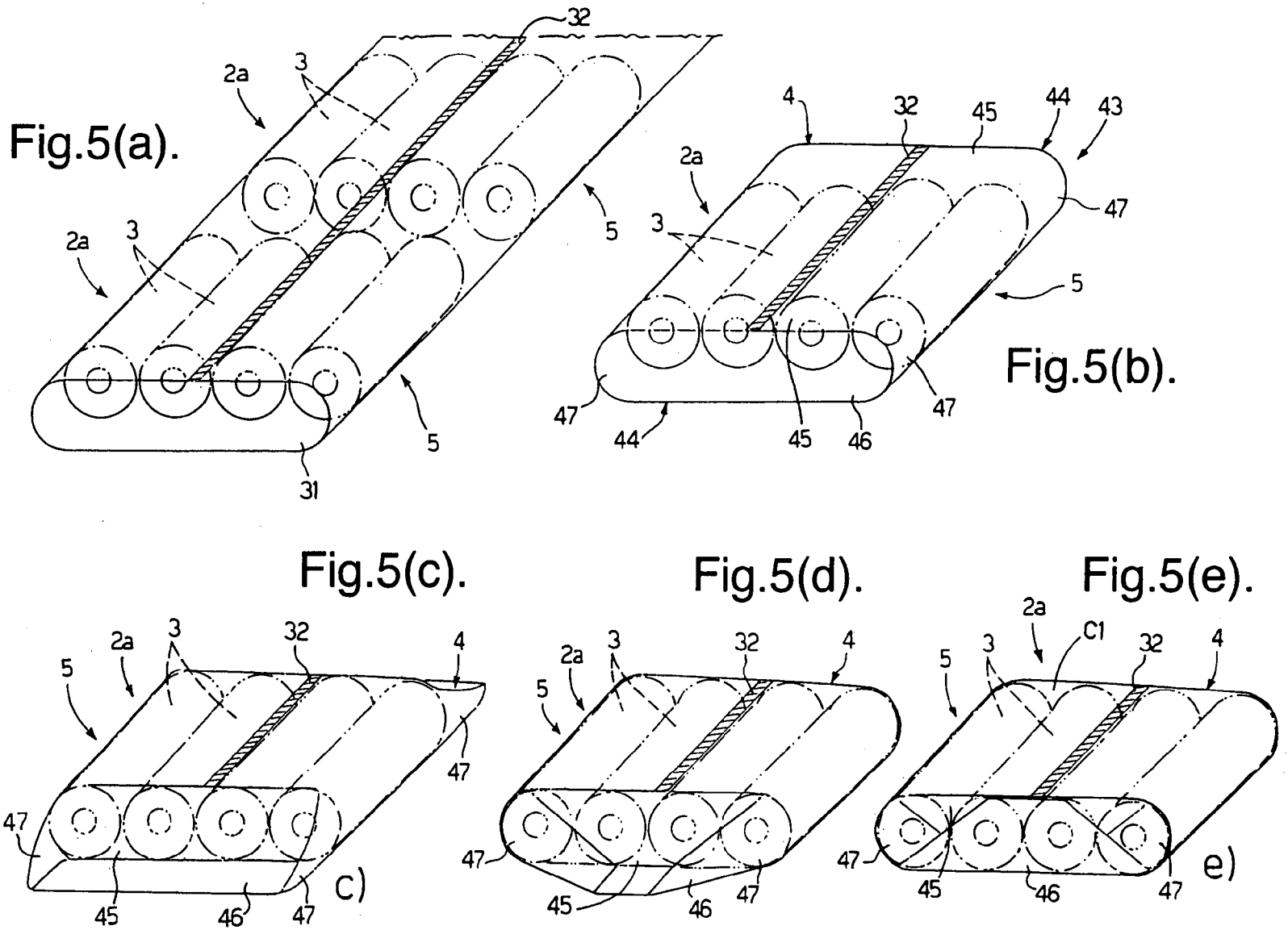
FIG. 5 schematically shows a first operating mode of the packaging machine of FIGS. 1 through 4.

Each group 2*a* is then advanced in continuous fashion in the direction 15 from a thrust element 54 to be brought in contact with a first known folding device 55 able to fold the related lateral portions 47 positioned posteriorly in the direction 15 substantially in contact with the group 2*a* itself and above the related portions 45 (FIG. 5*d*). Subsequently, the group 2*a* is brought in contact with a second known folding device 56 able to fold the portions 47 positioned anteriorly in the direction 15 substantially in contact with the group 2*a* and above the related portions 45 (FIG. 5*d*) and to fold the lower portions 46 substantially in contact with the group 2*a* and above the related portions 45 and 47 (FIG. 5*e*).

The devices 55 and 56 then cause the closure of the ends 44 transforming the tubular wrappers 43 into closed wrappers C1, each of which has two superposition areas defined by the portions 45, 46, and 47, and is stabilised by means of two head seals performed by a sealing device 57 comprising two belt conveyors 58, which are heated to a determined temperature, and have respective vertical transport branches positioned in direct contact with the wrapping sheets 4.

To wrap the groups 2*b*, the pre-notching roller 33, the longitudinal sealing device 39, the blades 40, and the switching device 48 are moved to their resting positions, and the forming device 30 is replaced according to the number n of layers 5 of the groups 2*b*.

As shown in FIGS. 3 and 4, at the output of the forming device 30, the groups 2*b* are uniformly distributed along the case 31 in such a way that each group 2*b* is positioned between two free tubular portions 59 of the case 31, which is pre-stabilised in releasable fashion by means of the electrostatic loading of the strip portions 29 defining the area 32, and is advanced in the direction 8, together with the groups 2*b*, by means of the conveyors 36, 37 and 41 and by means of an additional conveyor device 60 positioned in series with the conveyors 41 in the direction 8.

The device 60 advances the case 31 and the groups 2*b* in continuous fashion and with a substantially constant velocity V1 through a sealing station 61 comprising a known aspirating device 62 able to be positioned between the case 31 and the groups 2*b* to aspirate the air contained inside each portion 59, and a longitudinal sealing device 63 able to stabilise the are 32 by means of a sealing operation.

The device 60 then releases the case 31 and the groups 2*b* and a wrapping unit 64 comprising a plurality of upper sealing bars 65, in this case six bars 65, which extend in the direction 15, and are movable, under the thrust of the respective actuating devices, not shown herein, along a loop path P1 transverse to the bars 65, and a plurality of lower sealing bars 66, whose number is equal to the number of the bars 65, and are movable, under the thrust of respective actuating devices not shown herein, along a loop path P2, which is transverse to the bars 66, and has a horizontal segment common to the path P1 and defining a sealing path P.

Each bar 65 is advanced along the path P in phase with a bar 66 in such a way that each group 2*b* is engaged anteriorly and posteriorly in the direction 8 by respective pairs of bars 65, 66 to be advanced along the path P with a variable velocity of advance V2.

Figure 6B:
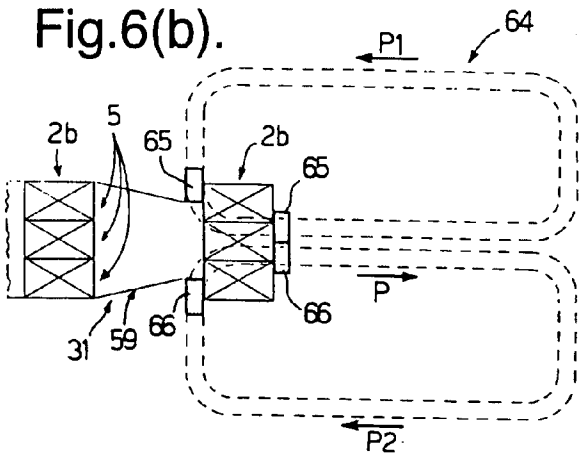
FIG. 6 schematically shows a second operating mode of the packaging machine of FIGS. 1 through 4.
Figure 6A:
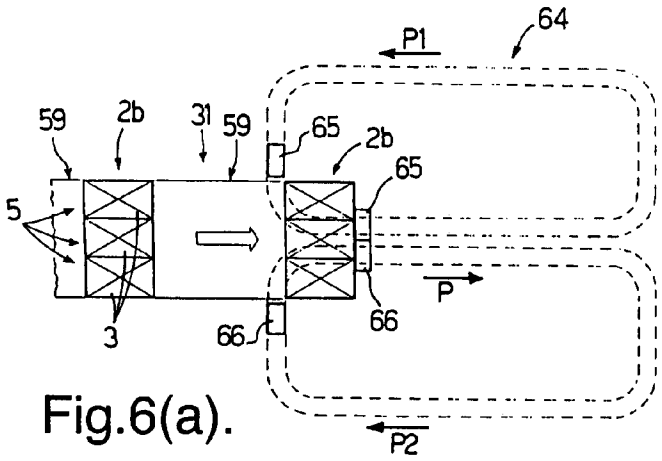
Figure 6C:
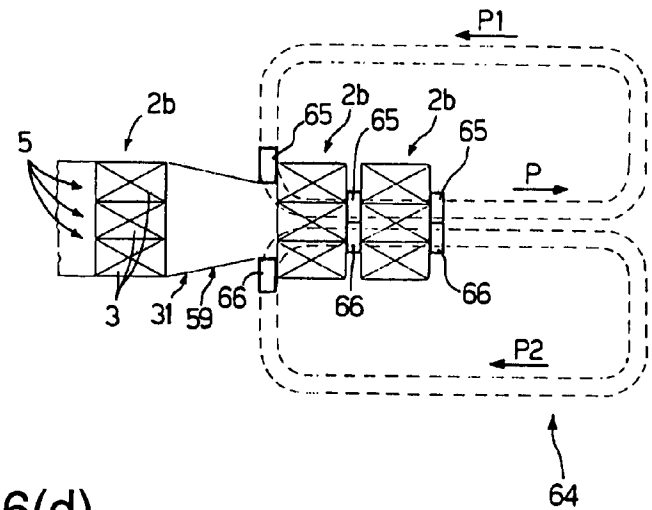
Figure 6D:
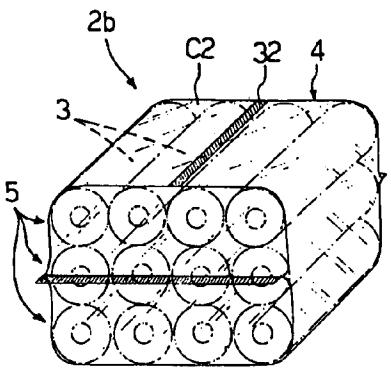

In correspondence with an initial segment of the path P, the velocity V2 of the bars 65, 66 is controlled in such a way as to be lower than the velocity V1 and thus to allow, combining the velocity V1 and V2, to fold each tubular portion 59 progressively in contact with the related groups 2*b* (FIGS. 6*a* and 6*b*). Subsequently, the bars 65, 66 of each pair of bars 65, 66 come in contact with each other with the interposition of a superposition area of the related portion 59 (FIG. 6*c*), stabilise said superposition area by means of a sealing operation, and separate from the case 31 a closed wrapper C2 (FIG. 6*d*).

Lastly, in correspondence with a final segment of the path P, the velocity V2 is controlled in such a way as to allow to each pair of bars 65, 66 to distance the related group 2*b* from the subsequent group 2*b*.

In should be specified, lastly, that:

each bar 65, 66 is electrically heated by means of a respective heating unit (not shown) comprising a voltage regulator device, whose operation is controlled in feedback by a control device mounted on the bar 65, 66 to measure the actual temperature of the bar 65, 66 itself; the wrapping units 27 and 64 are positioned along a substantially rectilinear path S, orthogonal to a path S2 defined by the folding devices 55 and 56 and by the sealing device 57; and the choice of wrapping the groups 2 in the closed wrappers C1 or C2 can be made according to the desired type of closed wrappers C1 or C2 and independently of the number n of layers 5 of the groups 2 and, consequently, the groups 2*a* can be wrapped in the closed wrappers C2 and the groups 2*b* can be wrapped in the closed wrappers C1.

The invention claimed is:

1. A packaging machine for wrapping groups of products in related wrapping sheets of heat-sealable material, each group comprising products arranged according to a determined number of mutually superposed layers, the machine comprising first wrapping means to form a tubular case from a continuous strip of heat-sealable material, the tubular case having a first longitudinal superposition area defined by superposition portions of the strip; conveyor means to feed in sequence groups of products into the tubular case, each group being positioned between two free tubular portions of said tubular case; stabiliser means to stabilise said first superposition area; separator means to separate in succession tubular wrappers from said tubular case, each of which wrappers is wound about a related group, and has two open tubular ends projecting from the related group; second wrapping means to fold each said tubular end substantially in contact with the related group, form a first external wrapper having two end superposition areas, and perform a sealing operation on the second superposition areas; and being characterised in that it further comprises third wrapping means to fold each said tubular portion substantially in contact with the related groups, perform a sealing operation on the tubular portion, and separate in succession from said tubular case second external wrappers wrapped around respective groups; and feeding means for selectively feeding the groups and the related tubular wrappers to said second wrapping means to obtain said first external wrappers and the groups and the tubular case to said third wrapping means to obtain said second external wrappers; said separator means being able to be selectively operated to separate the tubular wrappers from the tubular case.

2. A packaging machine as claimed in claim 1, wherein said feeding means are able to feed the groups and the related tubular wrappers to said second wrapping means when the number of layers is equal to one and to feed the groups and the tubular case to said third wrapping means when the number of layers is at least equal to two.

3. A packaging machine as claimed in claim 1, wherein said first and third wrapping means are positioned along a first determined path; said feeding means comprising switching means able to be selectively inserted into said first path to feed the groups and the related tubular wrappers to said second wrapping means.

4. A packaging machine as claimed in claim 3, wherein the switching means are able to be inserted into said first path when the number of layers is equal to one.

5. A packaging machine as claimed in claim 1, wherein the stabiliser means comprise first sealing means to stabilise said first superposition area by a sealing operation and pre-stabiliser means to pre-stabilise said first superposition area in releasable fashion; the first sealing means and the pre-stabiliser means being able to be selectively activated to obtain said first external wrappers and, respectively, said second external wrappers.

6. A packaging machine as claimed in claim 5, wherein said pre-stabiliser means are able to electrostatically charge said superposed portions of the strip.

7. A packaging machine as claimed in claim 5, wherein said third wrapping means comprise second sealing means to stabilise by means of a sealing operation the first superposition area, already pre-stabilised by said pre-stabiliser means.

8. A packaging machine as claimed in claim 1, wherein said conveyor means comprise a layering device able to superpose the layers one over the other to form the groups; the layering device being able to be selectively activated when the number of layers is at least equal to two.

9. A packaging machine as claimed in claim 1, wherein said first and third wrapping means are positioned along a first, substantially rectilinear path; said second wrapping means defining a second path, substantially transverse to said first path.

10. A packaging machine as claimed in claim 1, wherein said third wrapping means comprise at least two pairs of sealing devices able to advance the groups and the tubular case with a variable speed of advance in such a way as to fold each said tubular portion substantially in contact with the related groups.

11. A packaging machine as claimed in claim 10, in which each sealing device is movable along a respective loop path; the third wrapping means comprising, for each sealing device, actuator means able to move the sealing device itself along the related path with a motion law that is independent of the motion laws of the other sealing devices.

12. A packaging machine as claimed in claim 10, wherein said third wrapping means comprise, for each sealing device, heating means able electrically to heat the sealing device; each sealing device being provided with control means able to measure an actual temperature of the sealing device and to control said heating means according to said actual temperature.

* * * * *